US007891757B2

(12) United States Patent
Fellingham et al.

(10) Patent No.: US 7,891,757 B2
(45) Date of Patent: Feb. 22, 2011

(54) MARKING ELEMENT REGISTRATION

(75) Inventors: Peter J. Fellingham, San Diego, CA (US); David A. Neese, Escondido, CA (US)

(73) Assignee: Eastman Kodak Company, Rochester, NY (US)

( * ) Notice: Subject to any disclaimer, the term of this patent is extended or adjusted under 35 U.S.C. 154(b) by 224 days.

(21) Appl. No.: 12/241,124

(22) Filed: Sep. 30, 2008

(65) Prior Publication Data

US 2010/0079534 A1 Apr. 1, 2010

(51) Int. Cl.
*B41J 29/393* (2006.01)

(52) U.S. Cl. ..... 347/19; 347/37

(58) Field of Classification Search ..... 347/14, 347/15, 17, 19, 37, 43, 116
See application file for complete search history.

(56) References Cited

U.S. PATENT DOCUMENTS 5,448,269 A 9/1995 Beauchamp et al.
6,478,401 B1 11/2002 King et al.
2003/0016263 A1* 1/2003 Takahashi et al. ..... 347/19
2005/0099439 A1 5/2005 Folkins
2006/0061618 A1 3/2006 Hernandez et al.
2009/0315936 A1* 12/2009 Matsuura ..... 347/14

FOREIGN PATENT DOCUMENTS

EP 0 978 390 A1 2/2000
EP 1 952 999 A2 8/2008
JP 2007-268946 A 10/2007

* cited by examiner

*Primary Examiner*—Thinh H Nguyen
(74) *Attorney, Agent, or Firm*—William R. Zimmerli

(57) ABSTRACT

A method of measuring a relative offset between a first array of marking elements and a second array of marking elements in a printer; a registration target; and a printer are provided. The method includes printing a target by printing a first group of pixels using a plurality of marking elements from the first array and printing a second group of pixels using a plurality of marking elements from the second array; scanning the target to measure an optical characteristic of the target as a function of position along the target; and identifying a position at which an extreme in the optical characteristic of the target occurs.

18 Claims, 13 Drawing Sheets

MARKING ELEMENT REGISTRATION

FIELD OF THE INVENTION

The present invention relates generally to printers, and more particularly to determining misalignment between marking elements.

BACKGROUND OF THE INVENTION

Many printing systems include a plurality of arrays of marking elements, such that the different arrays print different types of dots on a recording medium in order to form an image. A familiar example is a color inkjet printer. The different arrays of marking elements in such a case would be the different groups of nozzles for printing cyan, magenta, yellow and black dots to form the image. (In addition to inkjet nozzles, other types of marking elements include light emitters such as LED's for electrophotography, heaters for thermal imaging, electrodes for electrography, magnetic elements for magnetography, etc.) Different arrays of marking elements can also consist of a first group of marking elements that print dots of a first size and a second group of marking elements that print dots of a second size, or a first group of marking elements that print dots of a color at a relatively high saturation and a second group of marking elements that print dots of substantially the same color but at a relatively low saturation. The dots on the recording medium need to be properly registered with each other or the image quality will be degraded.

The arrays of marking elements in a printer can be provided on a single printhead or on a plurality of discrete printheads. Especially for the case of marking element arrays being disposed on separate printheads, special measures are typically needed to correct for misalignment of different arrays of marking elements, because the mechanical tolerances of alignment of the different printheads may not be adequate to provide proper registration of the dots on the recording medium. In fact, even for different arrays of marking elements made on the same printhead, manufacturing defects or operational conditions can cause the dots from one array to be misaligned relative to the dots from another array.

In a carriage printer, the printhead or printheads are mounted on a carriage that is moved past the recording medium in a carriage scan direction as the marking elements are actuated to make a swath of dots. At the end of the swath, the carriage is stopped, printing is temporarily halted and the recording medium is advanced. Then another swath is printed, so that the image is formed swath by swath. In a carriage printer, the marking element arrays are typically disposed along an array direction that is substantially parallel to the media advance direction, and substantially perpendicular to the carriage scan direction. Corresponding marking elements from the different arrays arrive proximate a given pixel location on the recording medium at different times, so that some types of misalignment can be compensated for by suitable relative timing of actuation of the marking elements. Other types of misalignment can be compensated for by selecting which marking element from one array should correspond to which marking element from a different array for printing the same pixel locations. For example, for ideal registration of the marking element arrays, marking element 1 of cyan would correspond to marking element 1 of yellow, etc. However, for a misregistered set of arrays such that the cyan, magenta and yellow arrays are misaligned relative to the media advance direction, a better choice for improved image quality, for example, might be to have marking element 1 of yellow correspond to marking element 2 of cyan and to marking element 3 of magenta.

In order to know how to compensate appropriately for misalignment of arrays of marking elements, one must measure the misalignment. This is typically done by printing and scanning an alignment test pattern, where the scanning may be done by a document scanner, or by a light emitter and photosensor that are mounted on the carriage, for example.

U.S. Pat. No. 5,448,269 and U.S. Pat. No. 6,478,401 provide examples of printhead alignment test patterns. However, as printhead resolution and image quality increase, there is a need for alignment test methods and registration test patterns having improved accuracy. In addition, some prior art alignment test methods and registration test patterns are susceptible to error due to random dot placement errors (such as from misdirected jets for an inkjet printhead). Therefore there is also a need for reduced sensitivity to image noise in alignment test methods and registration test patterns.

SUMMARY OF THE INVENTION

According to one aspect of the present invention, a method of measuring a relative offset between a first array of marking elements and a second array of marking elements in a printer includes printing a target by printing a first group of pixels using a plurality of marking elements from the first array and printing a second group of pixels using a plurality of marking elements from the second array; scanning the target to measure an optical characteristic of the target as a function of position along the target; and identifying a position at which an extreme in the optical characteristic of the target occurs.

According to another aspect of the present invention, a registration target includes a reference pattern and a registration pattern. The reference pattern includes pixels of a first type located in a plurality of first regions that are spaced apart from one another. The registration pattern includes pixels of a second type located in a plurality of second regions. The plurality of second regions are successively incrementally offset from the plurality of first regions such that the degree of overlap between the plurality of first regions and the plurality of second regions varies along the target.

According to another aspect of the present invention, a printer includes a first array of marking elements; a second array of marking elements; a sensor; and a controller. The controller is configured to control printing patterns of the first array and the second array so that a target can be printed, to receive data from the sensor after the sensor scans the target to measure an optical characteristic of the target as a function of position along the target, and to identify a position at which an extreme in the optical characteristic of the target occurs.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
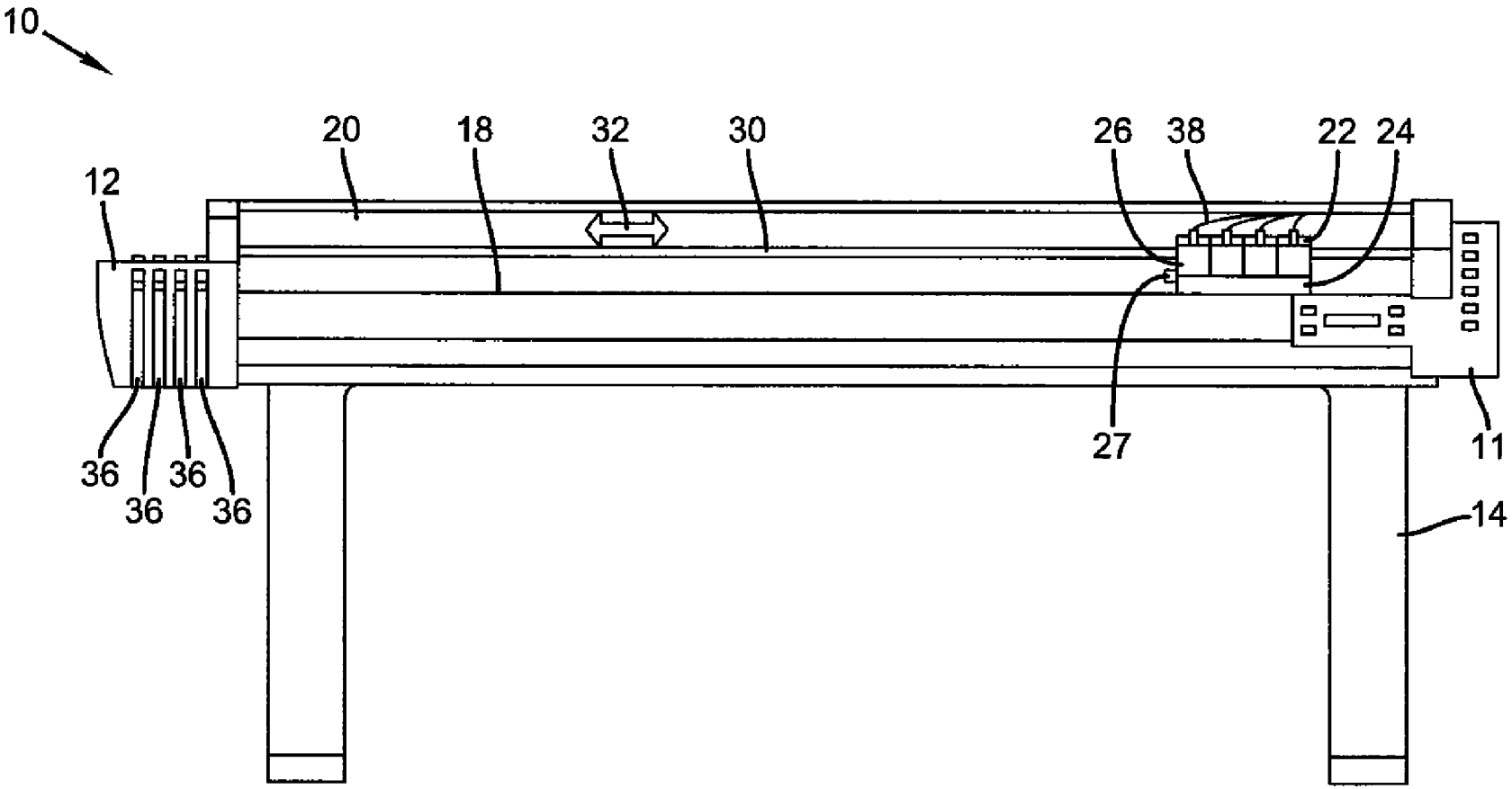
FIG. 1 illustrates a wide format inkjet printing system.

Referring to FIG. 1, one specific embodiment of a large format ink jet printer 10 includes right and left side housings 11, 12, and is supported by a pair of legs 14. The right housing 11, shown in FIG. 1 with a display and keypad for operator input and control, encloses various electrical and mechanical components related to the operation of the printer 10. The left housing 12 encloses ink reservoirs 36 which feed ink to the ink-jet printheads 26 via plastic conduits 38, which run between each ink-jet printhead 26 and each ink reservoir 36. In some printer embodiments, no separate ink reservoirs 36 or tubing 38 is provided, and printing is performed with ink reservoirs integral to the printheads.

Either a roll of continuous print media (not shown) is mounted to a roller on the rear of the printer 10 to enable a continuous supply of paper to be provided to the printer 10 or individual sheets of paper (not shown) are fed into the printer 10. (The terms paper, media and print media will be used interchangeably herein.) A platen 18 forms a horizontal surface that supports the print media, and printing is performed by select deposition of ink droplets onto the paper. During operation, a continuous supply of paper is guided from the roll of paper mounted to the rear of the printer 10 across the platen 18 by a plurality of rollers (not shown), which are spaced along the platen 18. In an alternate usage of printer 10, single sheets of paper or other print media are guided across the platen 18 by the rollers (not shown). A support structure 20 is suspended above the platen 18 and spans its length with sufficient clearance between the platen 18 and the support structure to enable a sheet of paper or other print media which is to be printed on to pass between the platen 18 and the support structure 20.

The support structure 20 supports a carriage 22 above the platen 18. The carriage 22 includes a plurality of ink-jet printhead holders 24, and a plurality of replaceable ink-jet printheads 26 mounted therein. In the example shown in FIG. 1, four printheads 26 are mounted in the holders 24 on the carriage 22, although it is contemplated that any number ink-jet printheads 26 can be provided. During printing, the carriage 22 is moved along guide rail 30 in carriage scan direction 32 as ink drops are ejected in image-wise fashion to print a swath of the image onto the media. The carriage location along the carriage scan direction 32 is tracked using an encoder (not shown) in order to properly position the drops. At the end of each swath, the carriage is stopped and the media is advanced in a media advance direction that is substantially perpendicular to carriage scan direction 32.

Also optionally attached to carriage 22 is reflectance sensor 27. Reflectance sensor 27 is an optical sensor that includes a light source (not shown) that is directed toward the recording medium, and a photosensor (not shown) that receives light originating from the light source and reflected off the recording medium. Depending upon the mounting angles of the light source and photosensor, the light received by the photosensor can be diffuse reflected light or specular reflected light. Reflectance sensor 27 can be used to sense alignment patterns, such as those described below in the present invention. The photosensor of reflectance sensor 27 will have a field of view at the media surface having a dimension that is on the order of 1 mm to 5 mm, for example. As the carriage 22 is scanned across an alignment pattern (i.e. an alignment test target) that has been printed on the medium by marking elements on printheads 26, a greater electrical signal is produced in the photosensor when it receives more light reflected from the medium. Since the marked regions absorb more light than a sheet of white medium does, the more white paper that is exposed within the field of view, the greater the signal that is produced in the photosensor. The greater the signal is, the greater the measured optical reflectance is, but conversely, the lower the optical density is.

The large format inkjet printer is just one example of a printing system in which the present invention could be advantageously used. For example, the invention could also be used for measuring marking element registration in a desktop carriage printer. In addition, the marking elements can be of other types, rather than inkjet nozzles.

Figure 2:
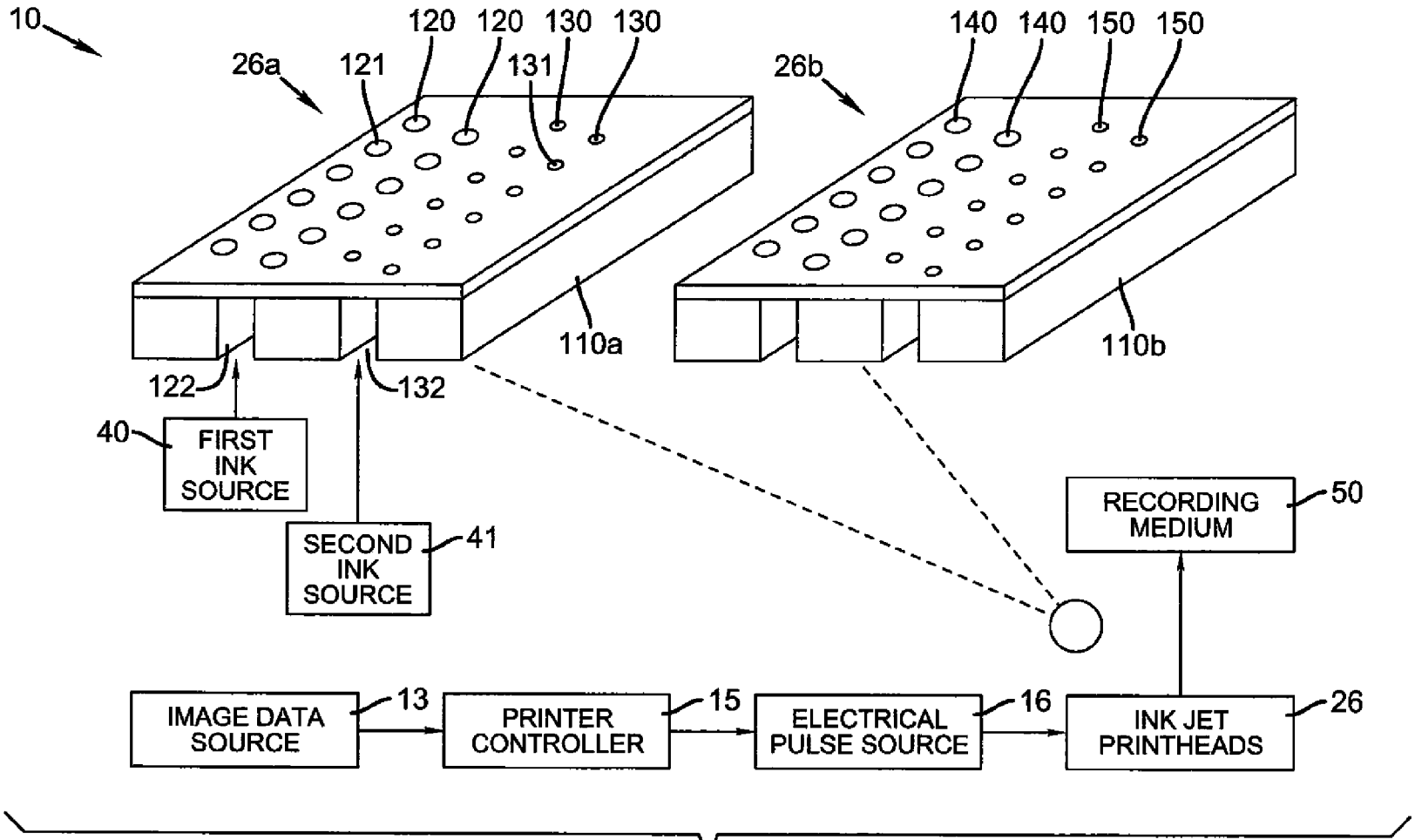
FIG. 2 is a schematic representation of an inkjet printing system.

FIG. 2 schematically illustrates an inkjet printer system 10. The system includes a source 13 of image data which provides signals that are interpreted by a controller 15 as being commands to eject drops. Controller 15 reformats the image data as needed for the printing, and outputs signals to a source 16 of electrical energy pulses that are inputted to one or more inkjet printheads 26 each of which includes at least one printhead die 110.

In the example shown in FIG. 2, there are two separate printheads 26*a* and 26*b*, each of which includes a printhead die 110*a* and 110*b* respectively. On each of the die 110 there are two nozzle arrays, i.e. marking element arrays. Nozzles 121 in the first nozzle array 120 on die 110*a* have a larger opening area than nozzles 131 in the second nozzle array 130 on die 110*a*. In this example, each of the two nozzle arrays has two staggered columns of nozzles, each column having a nozzle density of 600 per inch. The effective nozzle density then in each array is 1200 per inch. If pixels on the recording medium were sequentially numbered along the paper advance direction, the nozzles from one column of an array would print the odd numbered pixels, while the nozzles from the other column of the array would print the even numbered pixels.

In fluid communication with each nozzle array is a corresponding ink delivery pathway. For printhead 26*a*, ink delivery pathway 122 is in fluid communication with nozzle array 120, and ink delivery pathway 132 is in fluid communication with nozzle array 130. Portions of fluid delivery pathways 122 and 132 are shown in FIG. 2 as openings through printhead die substrate 110*a*. Printhead 26*b* and die 110*b* are configured similarly to printhead 26*a* and die 110*a*. For printhead 26*b*, the nozzle arrays are 140 and 150. One or more printhead die 110 will be included in each inkjet printhead 26, but only one printhead die 110 per printhead 26 is shown in FIG. 2. The printhead die for a given printhead are arranged on a support member (not shown).

In FIG. 2, first ink source 40 supplies ink to first nozzle array 120 via ink delivery pathway 122, and second ink source 41 supplies ink to second nozzle array 130 via ink delivery pathway 132. The ink sources for printhead 26*b* are not shown. Although distinct ink sources 40 and 41 are shown, in some applications it can be beneficial to have a single ink source supplying ink to nozzle arrays 120 and 130 via ink delivery pathways 122 and 132 respectively. Also, in some embodiments, fewer than two or more than two nozzle arrays can be included on printhead die 110. In some embodiments, all nozzles on a printhead die 110 can be the same size, rather than having multiple sized nozzles on a printhead die.

Not shown in FIG. 2 are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bilayer element) and thereby cause ejection.

In any case, electrical pulses from pulse source 16 are sent to the various drop ejectors according to the desired deposition pattern. In the example of FIG. 2, droplets ejected from nozzle array 120 are larger than droplets ejected from nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 50.

Because the nozzle array locations on a printhead die are typically formed at high precision using photolithography, while different printheads 26*a* and 26*b* are mechanically aligned with respect to one another at lower precision, in general, dots on the paper from arrays 120 and 130 will be somewhat well aligned to each other, and dots on the paper from arrays 140 and 150 will be somewhat well aligned to each other. However, dots from different printheads 26*a* and 26*b* (e.g. from array 120 relative to array 140) will be less well aligned to each other.

Figure 3:
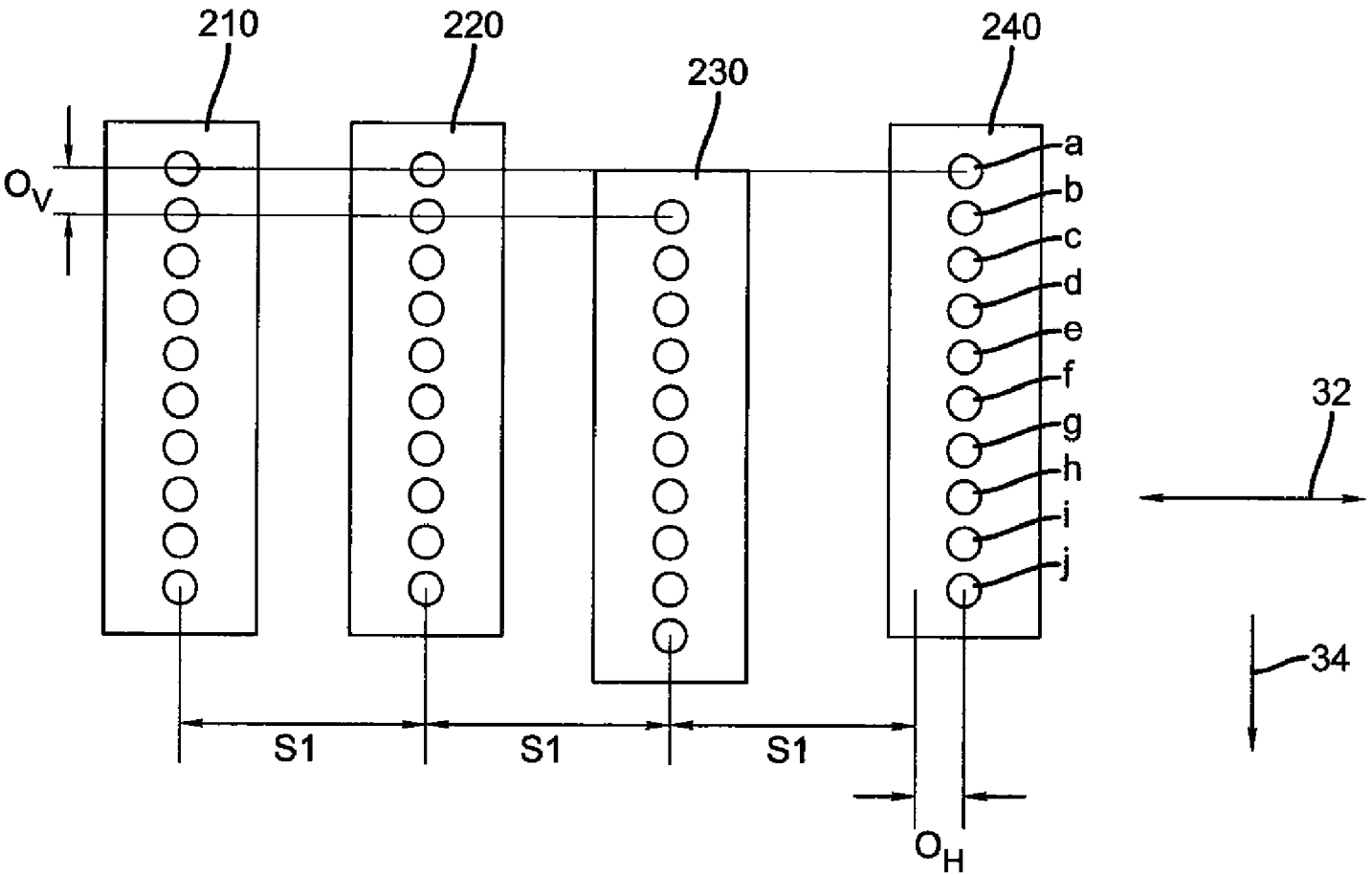
FIG. 3 is a schematic illustration of horizontal and vertical offsets between arrays of marking elements.

FIG. 3 schematically shows four marking element arrays 210, 220, 230, and 240, as well as their relative locations with respect to one another. Each marking element array in this example includes ten marking elements a, b, . . . j in a single column, and the marking elements in each array are disposed along an array direction that is substantially parallel to media advance direction 34. During printing, the four marking element arrays are scanned along carriage scan direction 32.

Nominally, each array is separated from the adjacent array by a distance S1, and nominally the corresponding marking elements (such as all of the a's) are aligned along the carriage scan direction 32. In other words, for ideal alignment of two arrays (as exemplified by marking element arrays 210 and 220), the actual distance between the arrays is S1, and a line drawn through the center of marking element a of marking element array 210 and parallel to carriage scan direction 32 will pass through the center of marking element a of marking element array 220.

Marking element array 230 is aligned along the carriage scan direction 32 with marking element array 220, since it is a distance S1 away. However, it is misaligned relative to marking element array 210 along the media advance direction 34, because there is an offset $O_V$ between a line drawn through the center of element a of marking element array 210 and a line drawn through the center of element a of marking element array 220, the lines being parallel to carriage scan direction 32. Offset $O_V$ is sometimes called a vertical offset or vertical misalignment, because in a typical carriage printer, such an offset along the media advance direction will be along the long edge of the paper. In the particular example shown in FIG. 3, the vertical misalignment $O_V$ is equal to one pixel spacing (the distance between marking element a and marking element b), but vertical misalignments of greater than a pixel spacing or less than a pixel spacing are also possible.

Also in the example shown in FIG. 3, marking element array 240 is aligned with marking element arrays 210 and 220 in the media advance direction 34, but it is misaligned relative to marking element array 230 in the carriage scan direction 32, because its distance from marking element array 230 is S1+$O_H$, rather than the nominal separation distance S1. The horizontal misalignment of the two arrays in this case is $O_H$. Since the distance between marking element array 240 and marking element array 220 is 2S1+$O_H$ rather than the nominal separation distance between next-nearest neighbor arrays of 2S1, the horizontal misalignment between marking element array 240 and 220 is also $O_H$. In the example of FIG. 3, $O_H$ is greater than zero and is approximately one pixel spacing horizontally. However the misalignment can also be less than zero and can be either greater than or less than one pixel spacing in magnitude. Marking element arrays can have both horizontal and vertical misalignment with respect to other marking element arrays. Marking element arrays can have rotational misalignment, such that the horizontal misalignment is not constant along the arrays.

An embodiment of the present invention includes printing a registration target using a plurality of marking elements from a first array and a plurality of marking elements from a second array, scanning the target to measure an optical characteristic (such as optical reflectance or optical density) as a function of position along the target, and identifying a position at which an extreme (maximum or minimum, depending on the optical characteristic measured as well as on the design of the target) occurs.

Figure 4A:
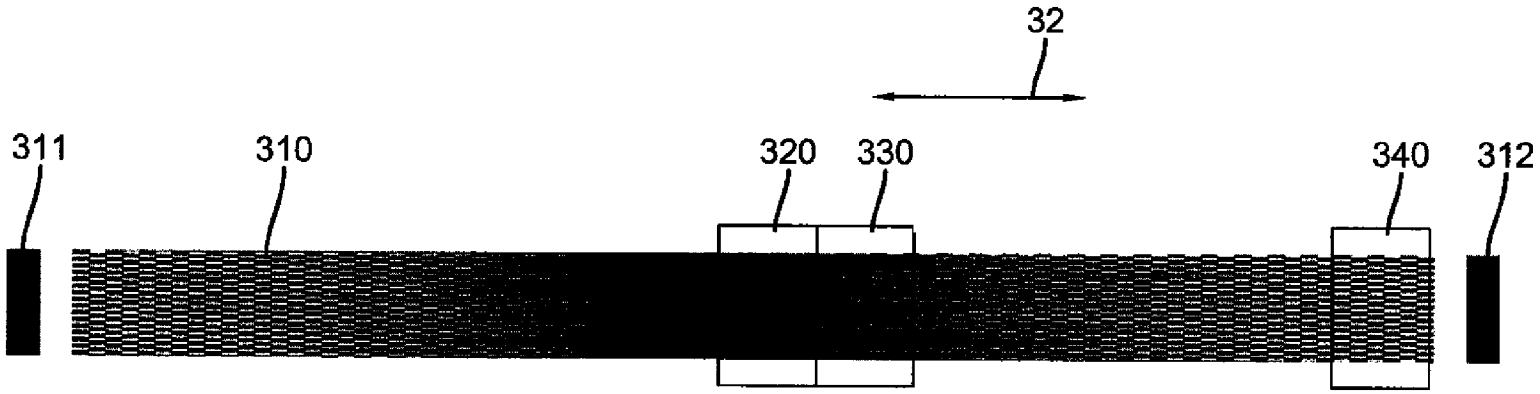
FIGS. 4A to 4D are magnified views of a vertical registration target according to embodiment of the present invention.
Figure 4B:
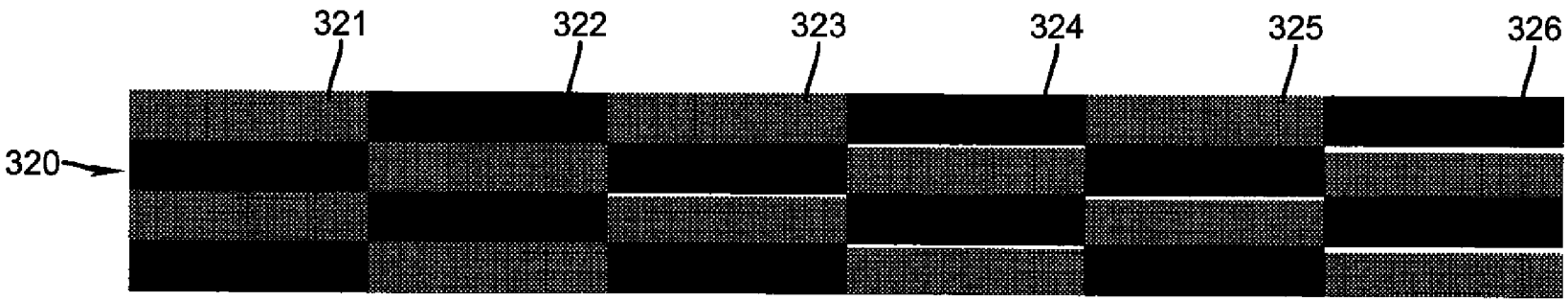
Figure 4C:
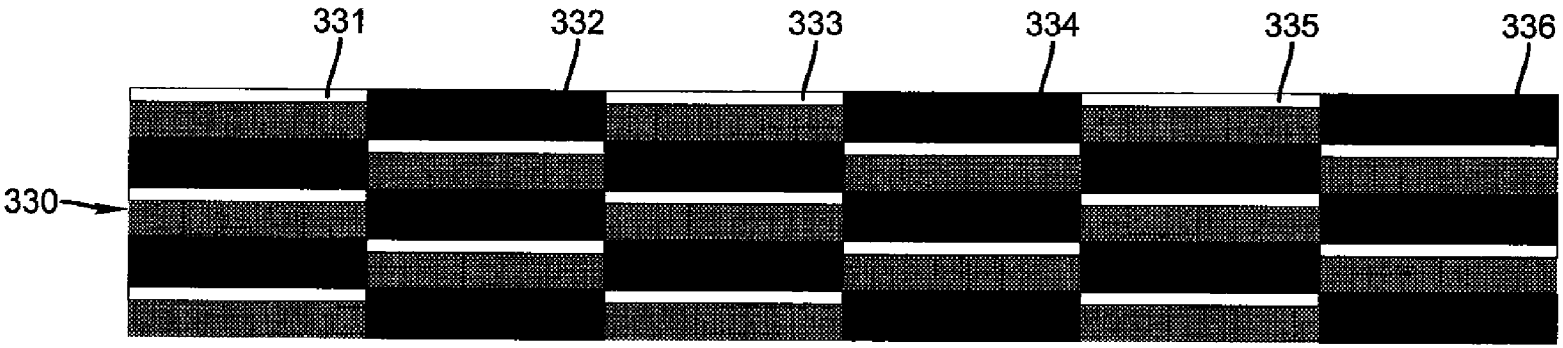
Figure 4D:
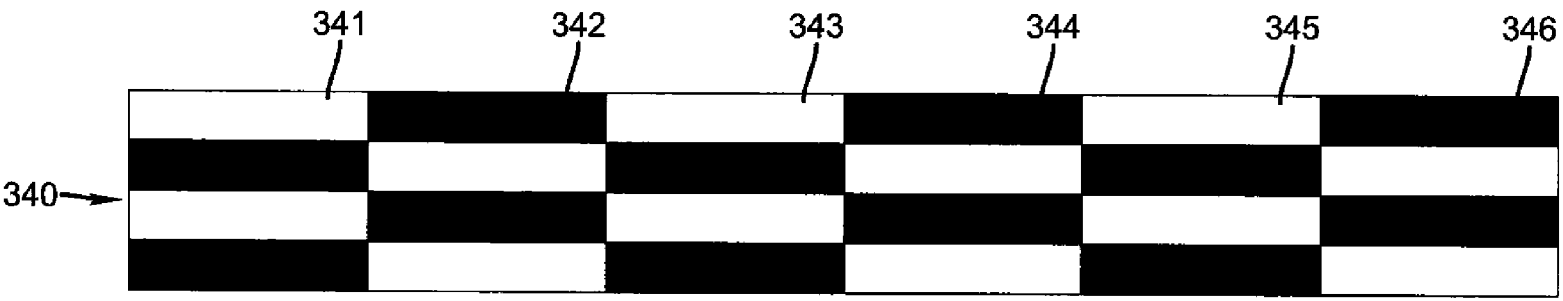

FIG. 4A shows an embodiment of a vertical registration target 310 of the present invention for measuring a vertical offset (i.e. an offset along the media advance direction) for one marking element array relative to another marking element array, at a magnification of approximately 1.5 times. FIGS. 4B, 4C and 4D show regions 320, 330 and 340 of the target respectively at a further magnification of about ten times relative to FIG. 4A. In this example, assume that the black regions are printed by an array of black marking elements with black ink and that the gray regions are printed by an array of cyan marking elements with cyan ink. However, the invention would be similar for different combinations of colors of marking element arrays, or for arrays printing different sized dots of the same color (where black might represent large dots and gray might represent small dots).

The vertical registration target 310 can be printed in a single pass in carriage scan direction 32 by the two marking element arrays, each having 640 marking elements at 1200 elements per inch, for example. The target 310 includes a black fiducial bar 311 at the left end, a checkerboard pattern of alternating black rectangles and partly cyan (gray)/partly white rectangles, and a black fiducial bar 312 at the right end. In this example, black is called the key color and the target is for cyan relative to black. The target image consists of a field of horizontal black rectangles arranged in a checkerboard pattern. Each black rectangle is 20 pixels vertically by 100 pixels horizontally. This black field of rectangles has a field of cyan rectangles of the same dimensions but a different pattern printed over it. The cyan rectangles are arranged such that (for perfectly aligned black and cyan arrays) in the center of the black field the cyan rectangles fall directly into the white space left between the black rectangles, so that the combination yields maximum optical density or minimum reflectance. At the left and right ends of the checkerboard pattern the cyan rectangles fall directly on top of or underneath the black rectangles such the combination exposes the most possible amount of white paper, thus yielding minimum optical density or maximum reflectance.

A magnified view of the region 320 just to the right of the center of the field of target 310 is shown in FIG. 4B. In columns 321 and 322, the alternating cyan (gray) rectangles fit precisely between the black rectangles. In columns 323 and 324, the cyan rectangles are offset down by one pixel relative to the black rectangles. In columns 325 and 326, the cyan rectangles are offset down by two pixels relative to the black rectangles. Similarly in region 330 shown magnified in FIG. 4C, in columns 331 and 332, the cyan rectangles are offset down by three pixels relative to the black rectangles, and so forth. Similarly in region 340 shown magnified in FIG. 4D, in columns 341 and 342, the cyan rectangles are offset down by eighteen pixels relative to the black rectangles. In columns 343 and 344, the cyan rectangles are offset down by nineteen pixels relative to the black rectangles. In columns 345 and 346, the cyan rectangles are offset down by twenty pixels relative to the black rectangles. In other words, for columns 345 and 346 the gray rectangles are directly on top of or underneath the black rectangles, so that a maximum amount of white paper is exposed in these columns.

A way in which target 310 could be printed in a single pass is as follows. Black marking elements 1-640 print fiducial bars 311 and 312. Within columns 322, 324, 326, 332, 334, 336, 342, 344, 346 and similar regions, the black rectangles are printed by black marking elements 1-20, 41-60, 81-100 . . . 601-620. Within columns 321, 323, 325, 331, 333, 335, 341, 343, 345 and similar regions, the black rectangles are printed by black marking elements 21-40, 61-80, 101-120, . . . 621-640. For column 321 the cyan rectangles are printed by cyan marking elements 1-20, 41-60, 81-100 . . . 601-620, and for column 322 the cyan rectangles are printed by cyan marking elements 21-40, 61-80, 101-120, . . . 621-640. If the black and cyan arrays are precisely aligned vertically (along the media advance direction 34, i.e. the array direction) the cyan rectangles in column 321 and 322 will fill all of the white space between the alternating black rectangles, providing a minimum in optical reflectance. However, if the two arrays are not precisely aligned vertically, then some amount of the cyan rectangles will fall on top of or underneath the black rectangles and some amount of white paper will be exposed in columns 321 and 322, so that the optical reflectance will not be as low as it would be if the two arrays were vertically aligned. In column 323 the cyan rectangles are printed by cyan marking elements 2-21, 42-61, 82-101 . . . 602-621, and in column 324, the cyan rectangles are printed by cyan marking elements 22-41, 62-81, 102-121, . . . 622-640. If the black and cyan arrays are precisely aligned vertically, the cyan rectangles will overlap the black rectangles by one pixel, so that a one-pixel-wide white streak is visible between the top of the cyan rectangles and the bottom of the black rectangles. If the cyan array is misaligned by one pixel spacing too high (along the media advance direction) relative to the black array, then the cyan rectangles will completely cover the white paper between the black rectangles in columns 323 and 324, so that the minimum in optical reflectance would occur in those columns instead of columns 321 and 322.

Stated more generally the black field of rectangles is a reference pattern including a plurality of black rectangles that are spaced apart from one another at regular spacings along the offset direction to be measured (the media advance direction). The cyan field of rectangles is a registration pattern including a plurality of cyan rectangles that are successively incrementally displaced along the offset direction relative to the black rectangles, such that a degree of overlap between the black rectangles and the cyan rectangles varies along the target. Moving left from the center of the black field, the cyan rectangles increment up in position by one pixel spacing p relative to the black field for each two columns of black rectangles. Moving to the right of the center of the black field the cyan rectangles increment one pixel down relative to the black field for each two columns of black rectangles. The direction is arbitrary and will also work if reversed. In both instances the optical density drops progressively from a peak at the middle of the image to a minimum at the ends for precisely aligned arrays. (Equivalently, the optical reflectance rises progressively from a minimum at the middle of the image to a maximum at the ends for precisely aligned arrays.) It is this wave in optical density or optical reflection that is used to provide the calibration signal for vertical registration of the two arrays.

The example shown in FIG. 4A is for cyan registering perfectly relative to black. In the event that the cyan color plane is shifted up or down by a number of pixels, the peak in optical density will shift left or right by that number of rectangle column pairs. A vertical shift of $^{12}/_{1200}$" (i.e. 0.01") will shift the density peak horizontally by 12 rectangle column pairs or $^{2400}/_{1200}$" (i.e. 2"). This gain of 200:1 is due to the fact that the rectangles pairs are 200 pixels long horizontally and each column pair is printed with a single pixel incremental shift. The gain could be adjusted up or down by using longer or shorter rectangles.

Suppose that the spacing between adjacent marking elements in the arrays is p (and hence the spacing between adjacent pixels in the target is p along the media advance direction 32), and that the rectangles of the reference pattern have a length L=np and a width W=mp. If the pixels of the registration pattern (corresponding to the marking elements of one array) have an average vertical offset error of a distance E=xp relative to the pixels of the reference pattern (corresponding to the marking elements of the other array), then the resulting position of an extreme in the degree of overlap between rectangles of the registration pattern relative to the rectangles of the reference pattern will be shifted horizontally by a distance X=nE relative to the nominal position of the extreme in the degree of overlap corresponding to a case of precise registration of the two arrays where E=0.

Longer rectangles allow accurate vertical calibration regardless of the horizontal registration calibration value used while printing the vertical calibration target. The vertical calibration signal strength approaches zero as the horizontal misregistration in pixels approaches one half the rectangle length.

To ensure a strong vertical calibration signal inside the possible range of horizontal misregistration, the rectangle length (in the direction perpendicular to the vertical offset direction) should be preferably at least 3 times the maximum anticipated horizontal misregistration D between the arrays of marking elements. The above target shows a ratio of approximately 10:1 and works very well. If the horizontal registration is correctly calibrated before printing the vertical calibration target, this consideration goes away. However, an advantage of embodiments where the rectangle length greater than three times the typical maximum horizontal misregistration (i.e. greater than 3D) that can be encountered in the printing system is that vertical registration can be performed even if horizontal registration and compensation by timing of the firing elements has not occurred.

The number of increments available both up and down relative to black is equal to the height of the rectangles in pixels; ±20 pixels in the example shown. The total number of black rectangle column pairs is equal to the total range of vertical calibration covered plus one pair for the zero in the middle, or 41 pairs in this instance.

If the vertical misregistration of the arrays at time of printing this target was greater than 20 pixels the density peak would move all the way to one side and wrap partway around to the other side of the target. If the vertical misregistration was 40 pixels the density peak would wrap all the way back to the center, giving a false reading of zero. For this reason, the vertical target image should have more rectangle column pairs than the largest misregistration anticipated for a given printing system. The target shown has ±20 pixels vertical range, but it is preferable to implement it in printing systems where the largest vertical misregistration error is anticipated to be ±15 pixels, in order to provide a safety margin.

The vertical calibration target can be printed in any print mode (including a single-pass print mode as described above), but a multi-pass mode is preferred, as this compensates for the effects of misdirection or misfiring of individual nozzles. Multi-pass print modes are well known in inkjet printing. For 4-pass printing with a 640 jet array, rather than having jet 1 print all the pixels in a given scan line, instead the printing responsibility can be assigned to jets 1, 161, 321 and 481, for example, and the media is advanced by the media advance system (e.g. motor-driven rollers) by ¼ of the active array length rather than the full array length at the end of each successive pass. Calibration target printing in 4-pass mode was demonstrated to easily achieve ±one pixel calibration accuracy and repeatability goals.

In a preferred embodiment of this invention, a reflectance sensor 27 is moved across the printed calibration target 310 along carriage scan direction 32. Thus, even though the vertical offset being measured is substantially parallel to the media advance direction 34, the target 310 is scanned along a direction that is substantially perpendicular to the direction of offset. The analog output of the reflectance sensor is converted to a one dimensional array of numbers using an analog to digital converter. (By converting the analog signal to digital data, it is then possible to use controller 15 to perform numerical analysis of the data and identify the position at which an extreme in the optical characteristic of the target occurs.) The value of each of these numbers corresponds to the level of reflectance measured at a particular location on the media. The positions of these numbers in the array correspond to positions on the media from which they were collected. The position along the target 310 can be referenced to the carriage location for a reflectance sensor 27 mounted on the carriage 22 using the same encoder that is used during printing. This array of numbers is referred to as a "calibration data set" and is used to determine the relationship between two groups of print elements.

Figure 5:
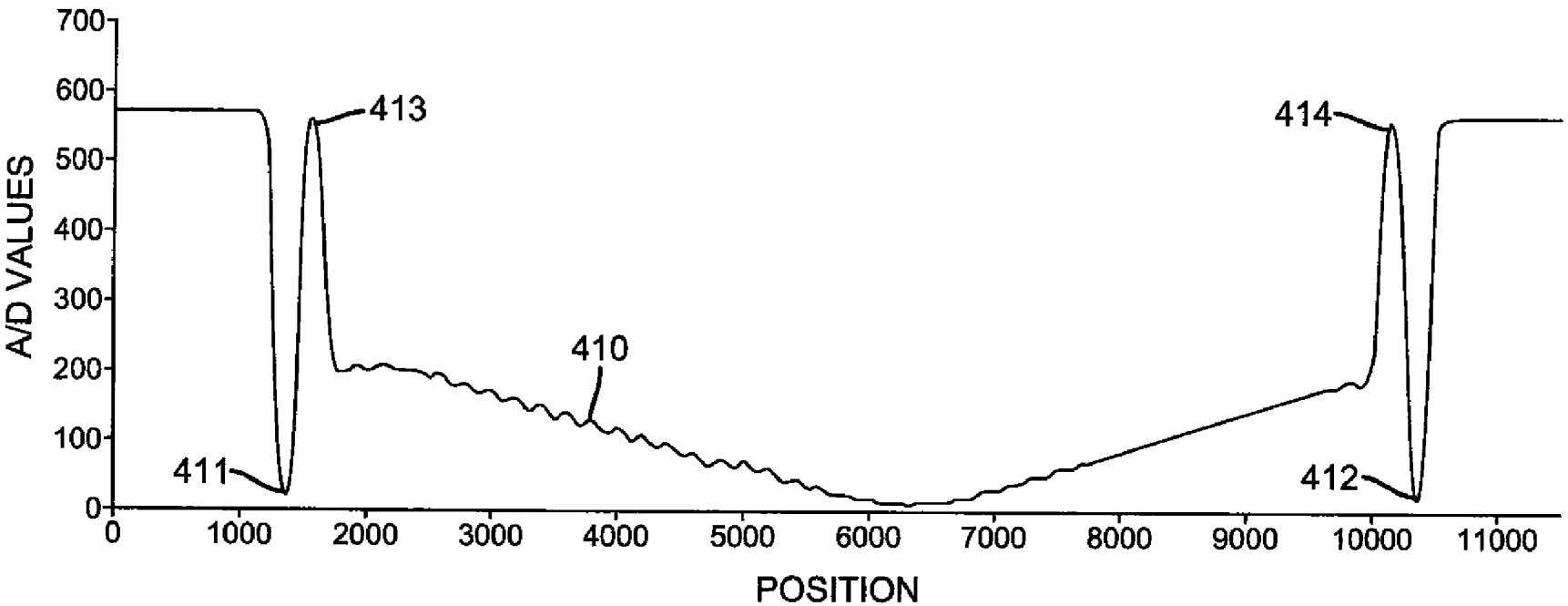
FIG. 5 is a graph of optical reflectance data corresponding to a target similar to that shown in FIG. 4A, but printed with a vertical offset in registration between marking element arrays.

A graph 410 of a typical calibration data set for vertical registration target 310 is shown in FIG. 5, but for the case where the target is printed with marking element arrays having a vertical registration error with respect to one another. In this graph, the Y axis represents the A/D value, or the level of reflectance. The X axis represents the relative positions from which the data was collected, as determined for example with reference to the linear encoder that provides the location of the carriage along the carriage scan direction. In this example, the position is in units of 1/1200 of an inch, although other data resolutions would be acceptable. In describing the method of data analysis, the term "position" will be used to refer to the X axis and the term "value" will be used to refer to the Y axis.

At the left and right edges of this graph are the high reflectance values of the unprinted media on either side of the printed calibration target 310. The fiducial bars 311 and 312 on each side of the target create the steep valleys 411 and 412 of low reflectance. Just inside two valleys 411 and 412 are two peaks 413 and 414 corresponding to the white region between the fiducial bars and the checkerboard pattern of rectangles in target 310. The region of the graph 410 between the peaks 413 and 414 shows the reflectance values of the calibration target 310 for the checkerboard pattern of rectangles.

In this embodiment of the invention, the vertical registration relationship between two arrays of marking elements is determined by the horizontal relationship between the center of the printed calibration target (the nominal position of the lowest reflectance for precisely registered arrays of marking elements) and the actual position of lowest reflectance within the printed calibration target. The fiducial bars 311, 312 and the corresponding valleys 411, 412 in the signal are used to determine the position of the center of the printed calibration target. This is done by finding the midpoint between highest reflectance value (white media) and lowest reflectance value (center of fiducial bars) and then determining the position of the first and last value in the data set that are lower than this value. Because the field of view of the reflectance sensor 27 has a nonzero extent along the carriage scan direction 32, the reflectance value does not drop immediately to the minimum when a fiducial bar 311 or 312 enters the field of view. Rather, the reflectance value drops from the highest value (white media) as more and more of the fiducial bar 311 or 312 enters the field of view. When the outside edge of the fiducial bar is at the middle of the field of view of the reflectance sensor 27, the reflectance value will be at the midpoint—so the first and last values that are lower than the midpoint of the reflectance value on the Y axis indicate the position of the outside edges of fiducial bars 311 and 312. For embodiments where vertical registration target 310 is symmetrically designed, the location on the X axis that is halfway between these two positions is the center of the printed target 310.

Figure 6:
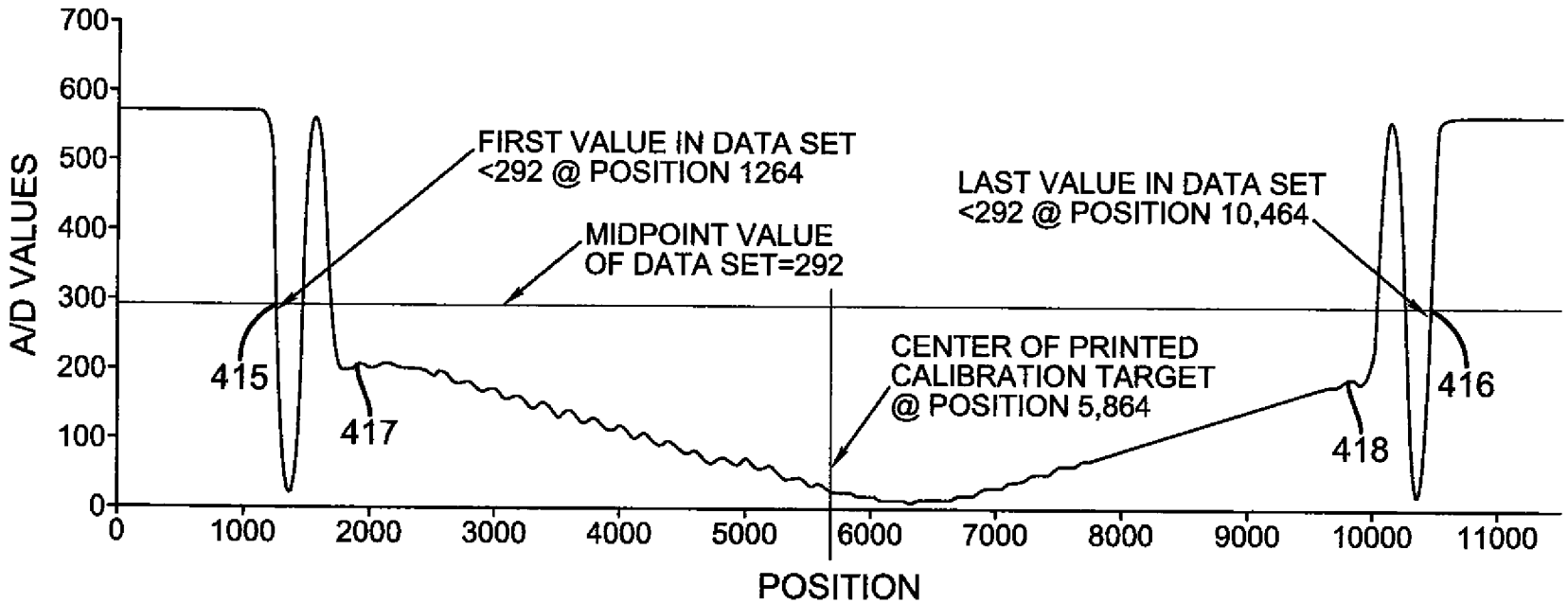
FIG. 6 is a graph of optical reflectance data corresponding to a target similar to that shown in FIG. 4A, but printed with a vertical offset in registration between marking element arrays.

FIG. 6 shows that, in this example, the highest A/D value is 576, the lowest A/D value is 8 and therefore, the midpoint reflectance value is 292. The position on the X axis of the first value 415 that is less than 292 is 1264 and the position on the X axis of the last value 416 that is less than 292 is 10,464. The point on the X axis that is halfway between these positions is 5,864. This is the position that corresponds to the center of the printed target 310.

Many other methods could be used to find the center of the printed calibration target with or without the use of fiducials. It is not intended that this invention be limited to the described method.

Likewise, many methods could be used to find the position of the minimum reflectance within the printed calibration target 310. The method described below for identifying a centroid of the low reflectance values has been found to have lower sensitivity to noise and greater robustness across system variables such as ink colors and nozzle health (i.e. misfirings and misdirectionality of ejected drops) than other methods tested. In addition, a horizontal offset between the marking elements of the two arrays printing target 310 does not affect the position of the optical centroid for vertical calibration.

Figure 7:
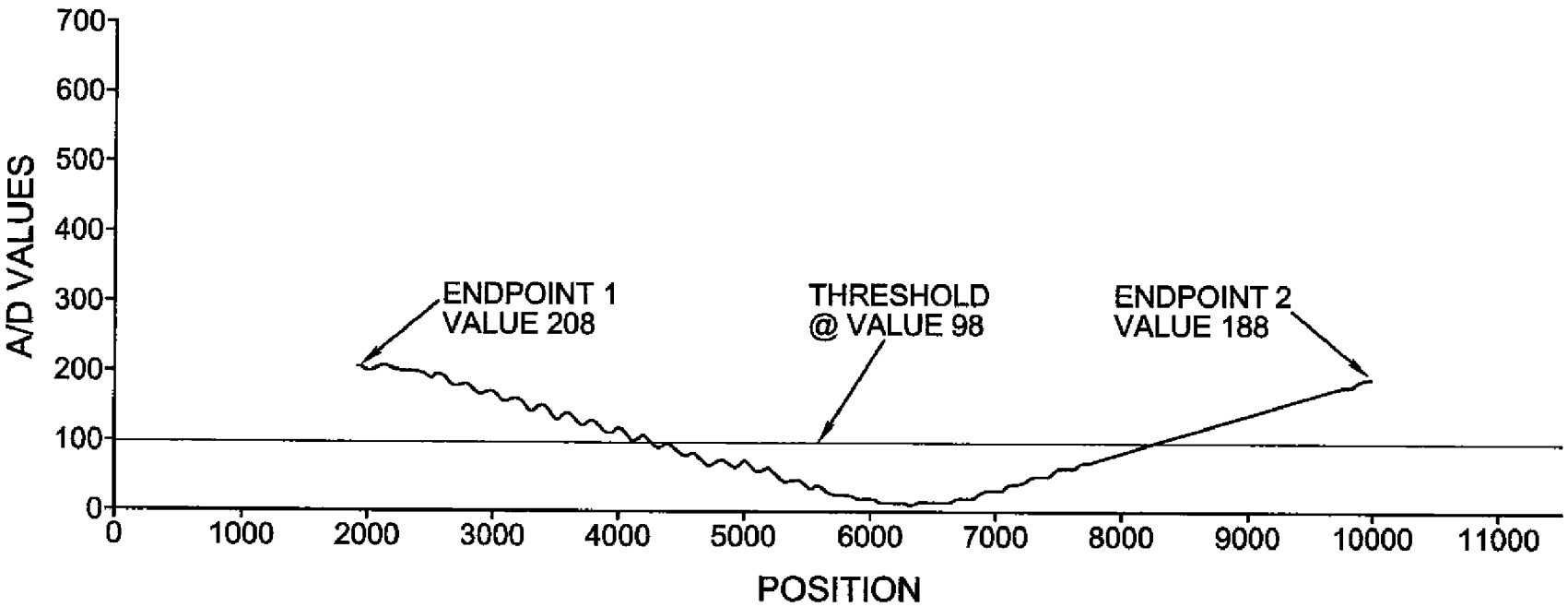
FIG. 7 is a graph of a portion of the optical reflectance data corresponding to the graphs of FIGS. 5 and 6.

The first step of this method is to remove the values associated with the white media and the fiducial bars 311 and 312 from the data set. This is done by offsetting from the fiducial positions 415 and 416 by a predetermined amount to define truncation endpoints 417 and 418, and truncating the data before and after these truncation endpoints. This allows a threshold to be determined by finding the midpoint value between the lowest value in the remaining data set and the lower value of the two endpoints 417 and 418 in the data set as shown in FIG. 7. The value at truncation endpoint 417 is 208 and the value at truncation endpoint 418 is 188, so 188 is the lower of the two values. The lowest value in the remaining data is 8, and the midpoint of 8 and 188 is 98 in this example, so the threshold value is 98. Although the midpoint was used in this example, other values such as a point that is 40% or 60% between the lowest value in the remaining data set and the lower value of the two endpoints 417 and 418. The intent is to focus on data that is relatively near to the extreme in the optical characteristic.

Only the values that are lower than this threshold value are used to determine the position of lowest reflectance. The position of the centroid of these remaining values is deemed to be the position of lowest reflectance. In order to find this centroid, these remaining values are subtracted from the threshold value yielding a series of values as shown by curve 420 in FIG. 8. These values are then summed to find the "area" under the curve 420. The position at which the sum of the values equals half the "area" under the curve 420 is deemed the centroid position 422 and therefore the position of lowest reflectance.

Figure 8:
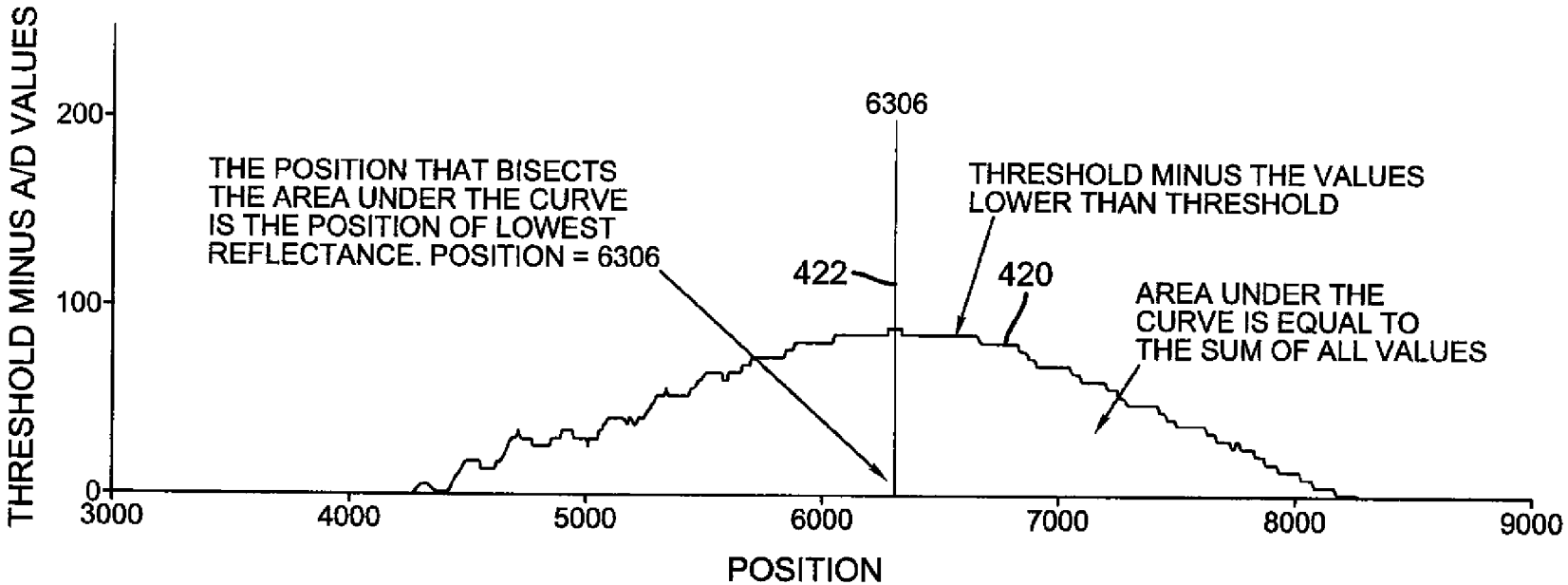
FIG. 8 is a graph of a portion of the numerically processed optical reflectance data corresponding to the target of FIG. 4A.

As seen in FIG. 8, the centroid position 422 of lowest reflectance was found to be at position 6306. Since the center of the calibration pattern was found to be at position 5,864, and the difference between 6306 and 5864 is 442, there is a positional offset of $^{442}/_{1200}$ of an inch. As described above, the pattern 310 used in this example has a 200:1 gain so the vertical registration error between the two arrays of marking elements can be calculated to be $^{2.21}/_{1200}$ of an inch ($^{442}/_{1200}$ths/200=$^{2.21}/_{1200}$ths). This information can be used to make physical adjustments in the vertical relationship between the two arrays of marking elements or manipulate image data to compensate for this error from nominal, i.e. by using controller 15 to reassign cyan image data to marking elements that are offset by 2 marking element spacings from the corresponding black marking elements (since one marking element spacing is $^{1}/_{1200}$th inch in this example). The remaining error of $^{0.21}/_{1200}$th inch would still remain but is so small that it would not be objectionable.

Figure 9A:
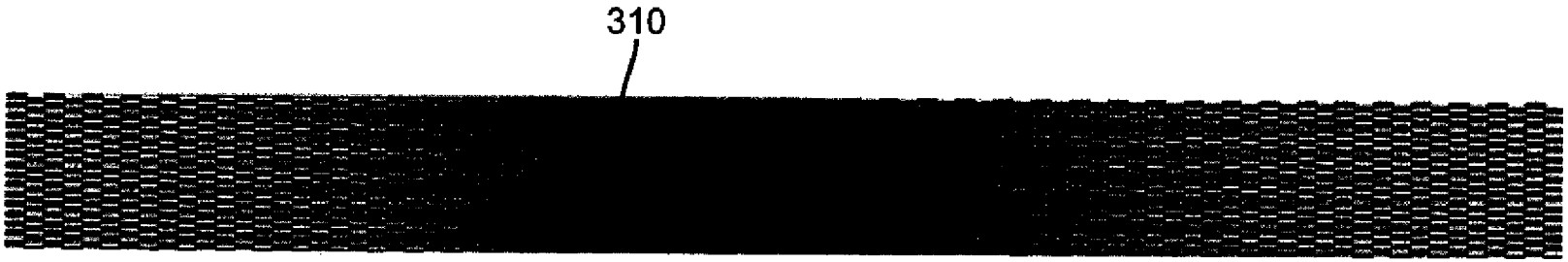
FIGS. 9A and 9B show views of portions of vertical registration targets according to embodiments of the present invention.
Figure 9B:
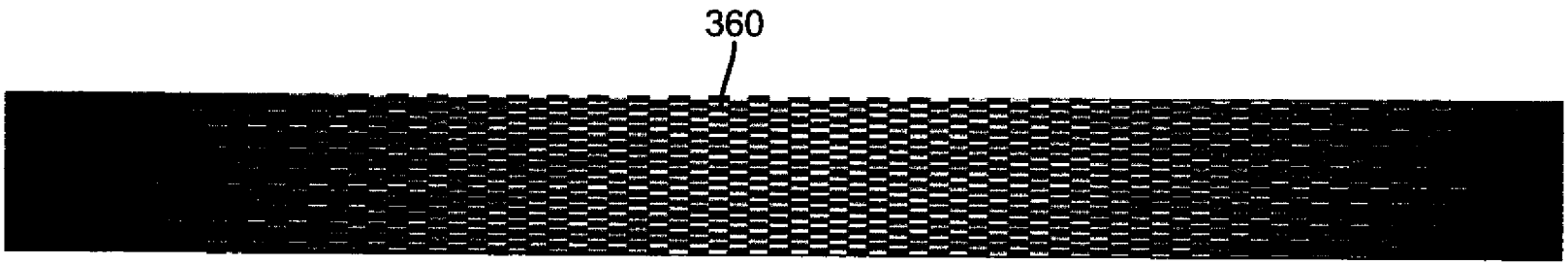

In the embodiment described above, vertical registration target 310 was designed to nominally have its lowest amount of overlap between the cyan and the black rectangles (and therefore its lowest optical reflectance) at the center of the target. Target 310 is shown again for reference in FIG. 9A for comparison to the target 360 in FIG. 9B according to another embodiment. Fiducial bars are not shown in FIG. 9A or 9B. Vertical registration target 360 was designed to nominally have its lowest amount of overlap between the cyan and the black rectangles (and therefore its lowest optical reflectance) at the ends of the target. In target 360, the highest optical reflectance is at the center of the target when printed with precisely aligned arrays. The method for determining the vertical registration error is similar to that described above relative to target 310.

Figure 10:
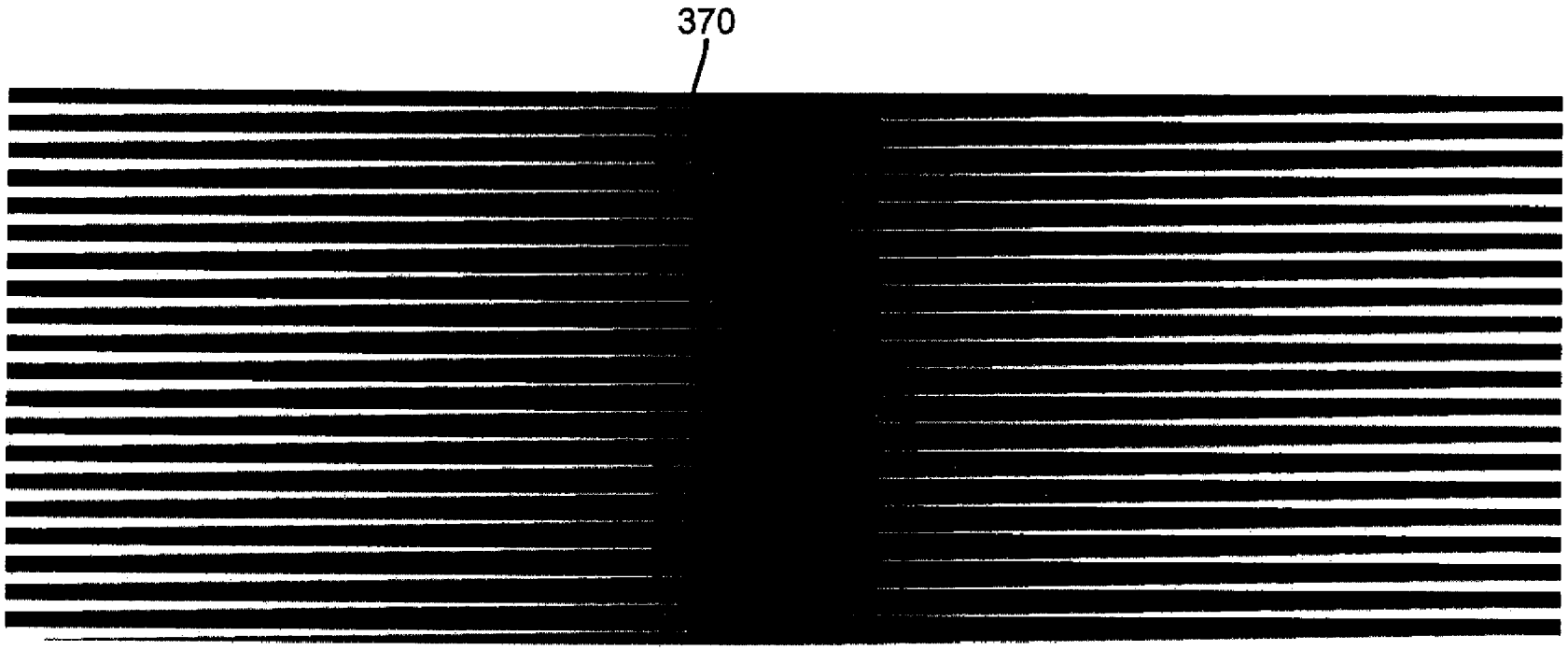
FIG. 10 shows a view of a portion of a vertical registration target according to an embodiment of the present invention.

Vertical registration targets 310 and 360 both include column pairs of rectangles arranged in a checkerboard pattern. This is an advantageous configuration because each rectangle column pair would be printed using all of the marking elements which provides averaging and reduced sensitivity to jet misdirection in a multi-pass print mode. However, it is also possible to use a vertical registration target 370 consisting of horizontal bars as shown in the magnified view of FIG. 10. The bar widths and spaces in registration target 370 are scaled to slightly exceed the maximum vertical misregistration anticipated for the marking element arrays. The reference bars 372 for the marking element array printing the key color are uninterrupted, while the registration bars 374 for the other marking element array have segmented bars that cascade up and down from the center in single pixel increments as the rectangles in test patterns 310 and 360 do. Horizontal bars would be printed using only 50% of the marking elements on average, so that registration target 370 is not quite as robust against jet misdirection as targets 310 and 360.

Figure 11:
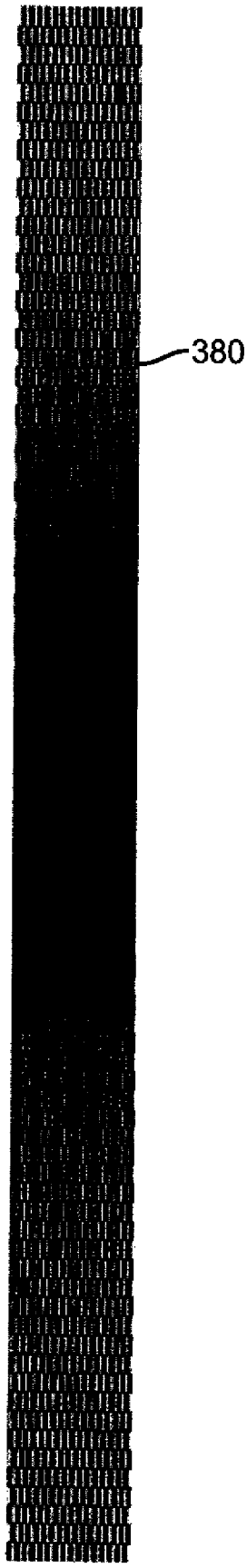
FIG. 11 shows a view of a portion of a horizontal registration target according to an embodiment of the present invention.

The embodiments described above are for measuring vertical registration errors, i.e. misalignments along the media advance direction 34 between different arrays of marking elements. The same types of targets and methods used for vertical registration can also be applied to horizontal registration, with the exception that both the target and the optical scanning direction would be rotated by 90 degrees. Thus, instead of measuring relative to the encoder that locates carriage 22 along the carriage scan direction 32, an encoder that is primarily used to monitor media feed would be used to determine the vertical position of the optical centroid. The vertical position of the optical centroid relative to the middle of the target indicates the horizontal offset between the two arrays used to print the pattern. Target 380 shown in FIG. 11 is an example of horizontal registration target for this embodiment. Target 380 has a combined vertical bar length of 200 pixels for each one pixel of horizontal offset, so it has a gain of 200 to 1, just as targets 310 and 360 do for vertical registration. The high gain, combined with integrating the optical centroid over a significant area, provides a high signal to noise ratio. One consideration of this embodiment is that the accuracy is somewhat dependent upon the media feed accuracy. Robustness against media feed instability and run-out increases with the length of the vertical bars. As with the vertical registration targets 310 and 360, the bar length along the media advance direction for horizontal registration target 380 needs to be at least two times the maximum anticipated vertical registration error (if vertical registration error has not first been compensated). The bar width needs to be greater than the horizontal offset that needs to be detected.

Figure 12:
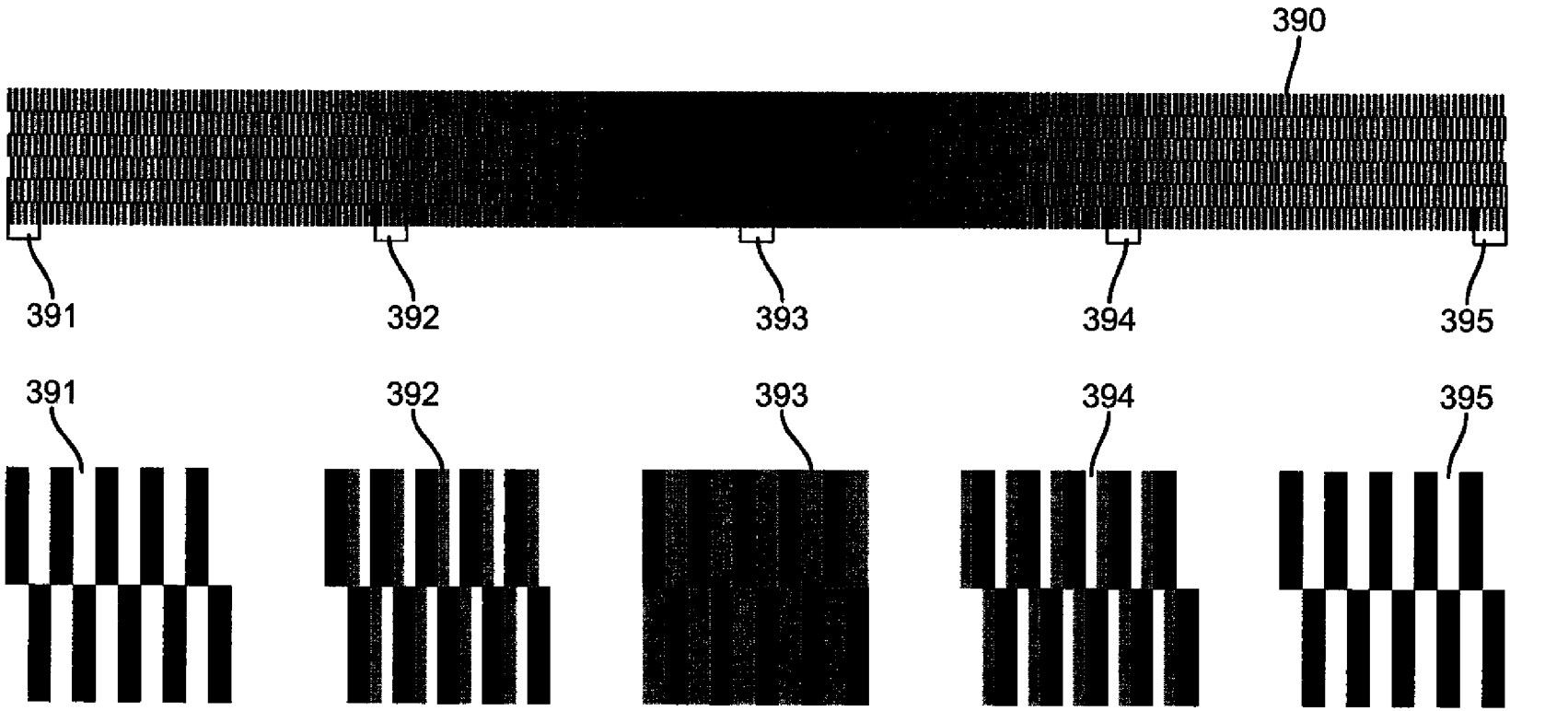
FIG. 12 shows a view of a portion of a horizontal registration target according to an embodiment of the present invention.

FIG. 12 illustrates another embodiment for measuring horizontal misregistration, in which the target 390 can be scanned along carriage scan direction 32 using reflectance sensor 27 in order to determine the optical centroid. Target 390 is shown at a magnification of approximately 1.5 times in FIG. 12, and particular regions 391, 392, 393, 394 and 395 are also shown at a further magnification of about 5 times in order to more clearly show the offsets along the target between the black reference pattern and the gray registration pattern. The width of each bar pair in exemplary target 390 is 40 pixels and the length along the media advance direction is 100 pixels. In target 390, the vertical bar length provides robustness against vertical registration errors applied while printing the target. The signal gain for target 390 is the width of a bar pair divided by the increment in the horizontal offset per bar pair—i.e. a one pixel horizontal registration shift between the marking element arrays used to print the target produces a forty pixel horizontal shift in the position of the optical centroid. One way to increase signal gain is to make the bar pairs wider. An alternative way to increase signal gain is to configure the pattern as clusters of bars (i.e. more than a pair of bars), where a one pixel horizontal registration shift occurs for each cluster of bars.

For printing the successively incremented offsets in the gray registration pattern, the relative timing of printing the marking elements of the two arrays is successively incremented as the carriage moves along the carriage scan direction 32. In the center of target 390 (near region 393), the marking elements for the gray registration pattern are timed to mark such that there would be no overlap with the black reference pattern if the horizontal registration is zero between the two marking element arrays. In regions such as 392 and 394 the timing of the marking of the gray registration pattern is such that there is partial overlap with the black reference pattern. At the end regions 391 and 395, there would be substantially complete overlap between the gray registration pattern and the black reference pattern if the horizontal registration error between the two marking element arrays is zero. The extent and direction of any horizontal misregistration will cause the minimum in optical reflectance to move away from the center of target 390, in a similar way to that described relative to target 310 for vertical misregistration. For measuring horizontal misregistration in the method of this embodiment, the marking element arrays are disposed substantially parallel to the media advance direction 34, the relative offset between the marking element arrays being along the carriage scan direction 32 that is perpendicular to the media advance direction 32, and the scanning of target 390 occurs along the carriage scan direction 32.

The invention has been described in detail with particular reference to certain preferred embodiments thereof, but it will be understood that variations and modifications can be effected within the scope of the invention.

PARTS LIST

10 Inkjet printer
11 Right side housing
12 Left side housing
13 Image data source
14 Legs
15 Controller
18 Platen
20 Support structure
22 Carriage
24 Printhead holders
26 Printheads
27 Optical reflectance sensor
30 Guide rail
32 Carriage scan direction
34 Media advance direction
36 Ink reservoirs
38 Tubing
40-41 Ink sources
50 Recording medium
110 Printhead die
120 Nozzle array
121 Nozzle
122 Ink delivery pathway
130 Nozzle array
131 Nozzle
132 Ink delivery pathway
140 Nozzle array
150 Nozzle array
210 Marking element array
220 Marking element array
230 Marking element array
240 Marking element array
310 Vertical registration target
311-312 Fiducial bars
320-326 Portions of target 310
330-336 Portions of target 310
340-346 Portions of target 310
360 Vertical registration target
370 Vertical registration target
380 Horizontal registration target
390 Horizontal registration target
391-395 Portions of target 390
410 Graph of reflectance data
411-412 Valleys
413-414 Peaks
415 First value less than midpoint value
416 Last value less than midpoint value
418-419 Truncation endpoints
420 Curve for locating centroid
422 Centroid position

The invention claimed is:

1. A method of measuring a relative offset between a first array of marking elements and a second array of marking elements in a printer, the method comprising the steps of:

printing a target by printing a first group of pixels using a plurality of marking elements from the first array and printing a second group of pixels using a plurality of marking elements from the second array, the relative offset being along an offset direction, the target including a first end, a second end, and a center that is positioned midway between the first end and the second end, wherein printing the target including the first group of pixels and the second group of pixels further comprises:

printing a reference pattern including a plurality of first regions spaced apart from one another along the offset direction using the plurality of marking elements from the first array; and printing a registration pattern including a plurality of second regions successively incrementally displaced along the offset direction from the plurality of first regions using the plurality of marking elements from the second array such that a degree of overlap between the plurality of first regions and the plurality of second regions varies along the target, wherein the optical characteristic varies according to the degree of overlap;

scanning the target to measure an optical characteristic of the target as a function of position along the target;

identifying a position at which an extreme in the optical characteristic of the target occurs; and comparing the position of the extreme in the optical characteristic to the position of the center of the target.

2. The method of claim 1, wherein the extreme in the optical characteristic is a maximum in the optical characteristic.

3. The method of claim 1, wherein the extreme in the optical reflectance is a minimum in the optical reflectance.

4. The method of claim 1, wherein identifying the position at which the extreme in the optical characteristic occurs includes analyzing a centroid of the optical characteristic.

5. The method of claim 1, the first array of marking elements and the second array of marking elements each being disposed substantially parallel to a first direction, the relative offset to be measured being parallel to the first direction, wherein scanning the target includes scanning the target along a second direction, the second direction being substantially perpendicular to the first direction.

6. The method of claim 5, further comprising:

providing a carriage including the first array of marking elements, the second array of marking elements and an optical sensor; and causing the carriage to move along the second direction, wherein printing of the target occurs as the carriage moves along the second direction, and scanning of the target is accomplished using the optical sensor as the carriage moves along the second direction.

7. The method of claim 6, the target being printed on a portion of media, the method further comprising:

providing a media advance system that advances the media along the first direction between successive passes of the carriage along the second direction, wherein printing the target includes printing the target during multiple passes of the carriage.

8. The method of claim 1, further comprising:

disposing the first array of marking elements and the second array of marking elements substantially parallel to a first direction, the relative offset to be measured being along a second direction that is perpendicular to the first direction; and scanning the target along the second direction.

9. The method of claim 1, the printer being an inkjet printer, the method further comprising:

printing the first group of pixels with a first ink; and printing the second group of pixels with a second ink.

10. The method of claim 1, wherein printing the registration pattern includes printing the plurality of second regions of the registration pattern such that a length of a second region in a direction perpendicular to the offset direction is greater than 3D, where D is a maximum offset that can occur in a direction perpendicular to the offset direction between the first array of marking elements and the second array of marking elements.

11. A registration target comprising:

a first end marker;

a second end marker;

a reference pattern including pixels of a first type located in a plurality of first regions that are spaced apart from one another; and a registration pattern including pixels of a second type located in a plurality of second regions, the plurality of second regions being successively incrementally offset from the plurality of first regions such that the degree of overlap between the plurality of first regions and the plurality of second regions varies along the target, wherein the nominal position of the extreme in the degree of overlap is located midway between the first end marker and the second end marker.

12. The registration target of claim 11, wherein the pixels of the first type are a different color than the pixels of the second type.

13. The registration target of claim 11, the reference pattern including a plurality of first rectangles, and the registration pattern including a plurality of second rectangles, the second rectangles being grouped into a first group and a second group, wherein the first group of the second rectangles substantially overlap the reference pattern, and the second group of the second rectangles substantially do not overlap the reference pattern.

14. The registration target of claim 13, wherein the first group of rectangles is disposed in a checkerboard pattern.

15. The registration target of claim 13, the spacing between adjacent pixels of the second type being a distance p, the plurality of first rectangles having a length L=np and a width W=mp, the location of the pixels of the second type having an average offset error of a distance E=xp relative to the location of the pixels of the first type, wherein the resulting position of an extreme in the degree of overlap between rectangles of the second type and rectangles of the first type is shifted by a distance X=nE relative to the nominal position of the extreme in the degree of overlap, the nominal position corresponding to a case of E=0.

16. The registration target of claim 11, the spacing between adjacent pixels of the second type being a distance p, wherein an amount of incremental offset between the registration pattern and the reference pattern in adjacent regions is p.

17. A printer comprising:

a first array of marking elements;

a second array of marking elements;

a sensor;

a controller configured to control printing patterns of the first array and the second array so that a target can be printed, to receive data from the sensor after the sensor scans the target to measure an optical characteristic of the target as a function of position along the target, to identify a position at which an extreme in the optical characteristic of the target occurs, and to compare the position of the extreme in the optical characteristic of the target to the position of a midpoint of the target.

18. The printer of claim 17, wherein the controller is configured to adjust actuation of one of the first array and the second array based on an offset calculated by the controller.

* * * * *